US007902768B2

(12) United States Patent
Zanforlin

(10) Patent No.: US 7,902,768 B2
(45) Date of Patent: Mar. 8, 2011

(54) DRIVING ARRANGEMENT FOR FEEDING A CURRENT WITH A PLURALITY OF LED CELLS

(75) Inventor: Nicola Zanforlin, Campodarsego (IT)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 109 days.

(21) Appl. No.: 12/085,375

(22) PCT Filed: Nov. 16, 2006

(86) PCT No.: PCT/EP2006/068551

§ 371 (c)(1),
(2), (4) Date: May 22, 2008

(87) PCT Pub. No.: WO2007/060129

PCT Pub. Date: May 31, 2007

(65) Prior Publication Data

US 2009/0267531 A1 Oct. 29, 2009

(30) Foreign Application Priority Data

Nov. 22, 2005 (EP) ..... 05425826

(51) Int. Cl.
*H05B 41/16* (2006.01)

(52) U.S. Cl. ..... 315/282; 315/247; 315/291; 315/312; 315/185 S

(58) Field of Classification Search ..... 345/102, 345/82–84, 88, 204, 211–214; 315/247, 315/246, 224, 291, 297, 307–326, 274–289
See application file for complete search history.

(56) References Cited

U.S. PATENT DOCUMENTS

| | | | | |
|---|---|---|---|---|
| 6,888,529 | B2 * | 5/2005 | Bruning et al. | 345/102 |
| 7,248,245 | B2 * | 7/2007 | Adachi et al. | 345/102 |
| 7,605,544 | B2 * | 10/2009 | Ushijima et al. | 315/282 |
| 2002/0070914 | A1 | 6/2002 | Bruning et al. | |
| 2007/0152608 | A1 * | 7/2007 | Lee | 315/282 |

FOREIGN PATENT DOCUMENTS

| | | | |
|---|---|---|---|
| EP | 1 215 944 | A1 | 6/2002 |
| WO | 2005/048658 | A1 | 5/2005 |

* cited by examiner

*Primary Examiner* — Tuyet Thi Vo

(57) ABSTRACT

A driving arrangement for feeding a current generated by a high frequency generator (10) coupled with a magnetic element (11) to a plurality of LED cells (33) each including at least one LED. The arrangement includes a respective plurality of LED channels (1, 2, 3, 4; 1', 2', 3', 4') arranged in a parallel configuration and one or more coupled inductors (L12, L23, L34) the couple in pairs the channels of the plurality of LED channels (1, 2, 3, 4; 1', 2', 3', 4').

9 Claims, 3 Drawing Sheets

DRIVING ARRANGEMENT FOR FEEDING A CURRENT WITH A PLURALITY OF LED CELLS

FIELD OF THE INVENTION

The invention relates to arrangements for driving light emitting diodes (LEDs).

The invention has been developed with specific attention paid to its possible use in arrangements including a plurality of LED cells, such as RGB LED cells, namely LED cells comprising an RGB trichromatic lighting system and in general in driving a multichromatic lighting system, e.g. defining a tunable-white lighting system.

DESCRIPTION OF THE RELATED ART

In addition to the use as display units, light emitting diodes (LEDs) are becoming increasingly popular as lighting sources. This applies primarily to so-called high-flux (HF) or high-brightness LEDs. Typically, these LEDs are arranged in cells, with each cell comprised of one or more LEDs coupled in a parallel/series arrangement.

A combination of a plurality of cells each including one or more LEDs having a given emission wavelength (i.e. respective "colour") produce combined light radiation whose characteristics (spectrum, intensity, and so on) can be selectively adjusted by properly controlling the contribution of each cell. For instance, three cells each including a set of diodes emitting at the wavelength of one of the fundamental colours of trichromatic system (e.g. RGB) produce white light and/or radiation of a selectively variable colour. Such arrangements may include i.a. so-called tunable-white systems adapted to produce white light of different "temperatures". Substantially similar arrangements may include cells each comprised of one or more LEDs of essentially the same colour and produce light sources whose intensities may be selectively adjusted to meet specific lighting requirements (for instance providing different lighting levels in different areas of a given space, a display area and so on).

In such arrangements the need arises of connecting in parallel two or more LED channels while avoiding the necessity of using active elements to control the current on each channel with different voltage drops.

Current solutions involve current regulators distributed along each channel. These introduce an additional voltage drop that causes non-negligible power losses, especially in the case of high current LEDs. A switching stage with current control can be introduced for every single channel to improve power dissipation. This however also introduces a number of additional power components and increases driver costs and complexity.

OBJECT AND SUMMARY OF THE INVENTION

While the prior art arrangements considered in the foregoing are capable of providing satisfactory operation, they still fail to provide a solution to the problem of avoiding the use of active elements to control the current delivered to different channels of LEDs with different voltage drops.

The object of the present invention is to provide a fully satisfactory solution to the problem outlined above.

According to the present invention, that object is achieved by means of a driving arrangement having the features set forth in the claims that follow. The claims are an integral part of the disclosure of the invention provided herein.

A preferred embodiment of the invention is thus a driving arrangement for feeding a current generated by a high frequency generator to a plurality of LED cells each including at least one LED, the arrangement including a respective plurality of LED channels arranged in a parallel configuration and one or more coupled inductors coupling in pairs said plurality of LED channels.

Essentially, the arrangement described herein takes full advantage of the introduction of the coupled inductors in the channels for performing current equalization of LED currents, even in presence of very different forward voltages in the channels.

Specifically, when applying a high frequency voltage source to a pair of LED channels exhibiting a different forward voltage and coupled with one coupled inductor, the unbalanced magnetic flux in the core of the coupled inductor determines a dynamic impedance that tends to compensate the different LEDs voltages, by substantially exerting a negative feedback action.

BRIEF DESCRIPTION OF THE FIGURES

The invention will now be described, by way of example only, with reference to the enclosed figures of drawing, wherein.

DETAILED DESCRIPTION OF THE INVENTION

Figure 1:
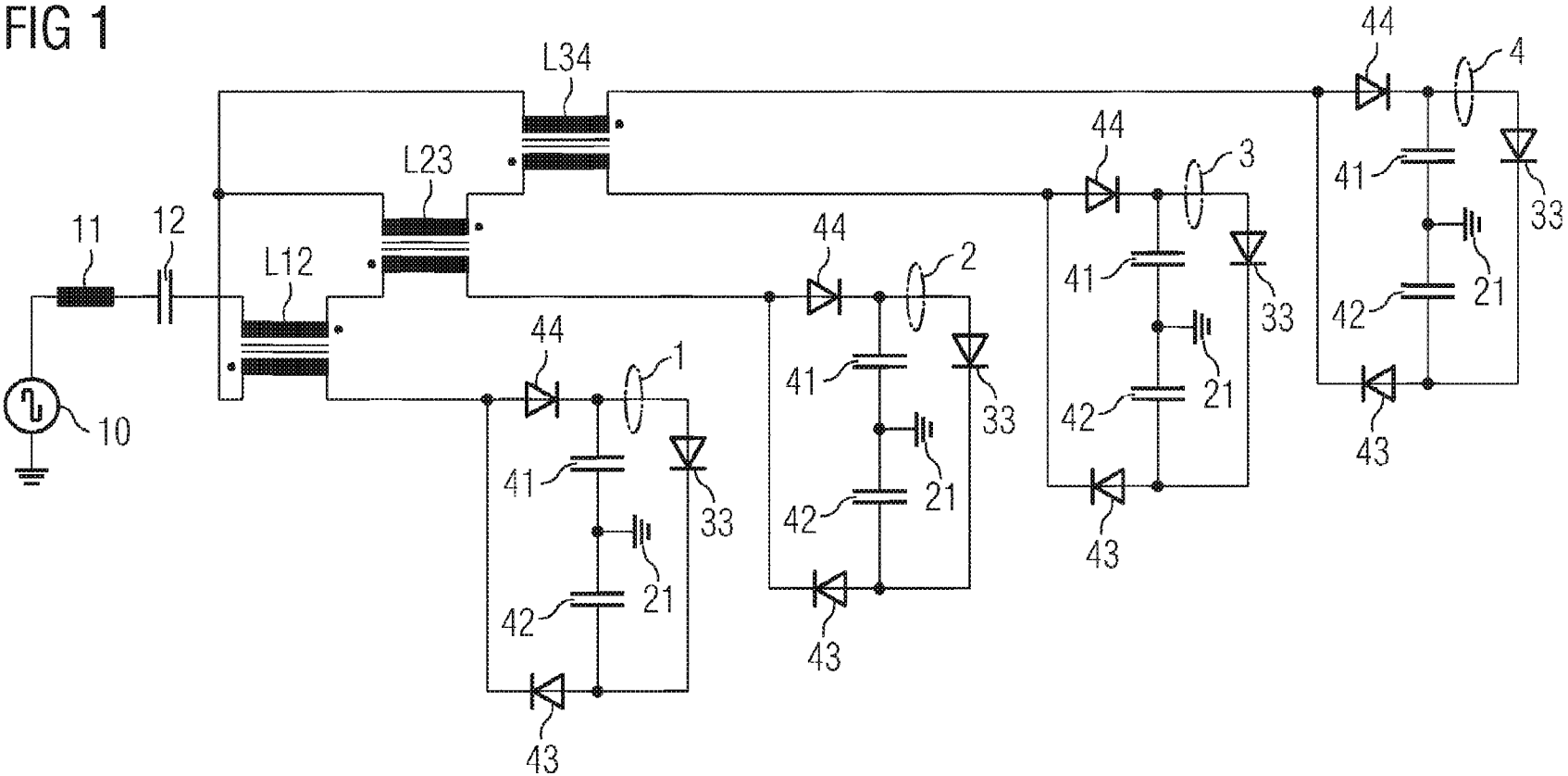
FIG. 1 is a circuit diagram exemplary of a first embodiment of the driver arrangement described herein.

FIG. 1 illustrates a circuit diagram of a driving arrangement for RGB LED cells. Such a driver stage is substantially a "buck" HF driver.

More specifically, in FIG. 1 reference numeral 10 denotes a square wave generator, which supplies its signal via a magnetic element 11, that is an inductor, and a decoupling capacitor 12, placed in series after such magnetic element 11, to four parallel channels, respectively indicated with reference numerals 1, 2, 3, and 4.

By way of example, the square wave generator 10 is a inverter applying a 24 V voltage to a 4, 7 nH inductor 11 and a 150 nF decoupling capacitor 12.

Each of the four parallel channels 1, 2, 3, 4 comprises a respective LED cell 33, including, in the example shown in FIG. 1, only one LED. Before the LED cell 33 a voltage doubler structure is arranged, comprising a reverse diode 43, connected to a ground point 21 through a first (preferably ceramic) capacitor 42 and a direct diode 44 connected to the ground 21 through a second (preferably ceramic) capacitor 41. The LED cell 33 is connected between the terminals of the ceramic capacitors 41, 42 that are not connected to the ground 21.

While all the "LED" channels 1, 2, 3, 4 replicate the same structure described so far, these channels 1, 2, 3, 4 can be regarded as arranged in pairs, with coupled inductors (i.e. transformers) L12, L23, L34 are placed in series to said decoupling capacitor 12 at the beginning of each channel, upstream the voltage doubler like structure.

More to the point:

the coupled inductor L12 includes a first coil (i.e. winding) on the channel 1 and a respective mutual coil on the channel 2, the coupled inductor L23 includes a first coil on the channel 2 and a respective mutual coil on the channel 3, and the coupled inductor L34 includes a first coil on the channel 3 and a respective mutual coil on the channel 4.

Such coupled inductors L12, L23, L34 allow a quasi perfect current equalization of LED currents also with very different forward voltages of the channels 1, 2, 3, 4.

If a high frequency voltage source is applied to two LED cells with different values of the forward voltage Vf and coupled with one of such a coupled inductor, a dynamic impedance, caused by the unbalanced magnetic flux in the core of the coupled inductor, is automatically created which tends to compensate the different LEDs voltages.

Specifically, an increase in the current in one channel caused by a low forward voltage Vf, will produce an increase of dynamic impedance seen by this channel, essentially in the form of negative feedback.

In order to use coupled inductor as current equalizers it is avoided applying continuous voltage to the magnetizing inductance which leads to magnetic core saturation. In addition, in order to have a correct behaviour of the coupled inductor, a reset of the current flowing in the coupled inductor is performed. The arrangement described herein is thus particularly suitable where a HF voltage or current source is present.

Only small size magnetic cores are required if coupled inductors are used as just described; in fact no safety insulation is required to decouple two different LED channels (no creepage/clearance distances) and only a small unbalanced flux is present (low core dimensions).

By way of example, with LED cells 33 showing a resistance of 9 Ohms and a forward voltage Vf of 10, 13.5, 15, and 20 V for the parallel channels 1, 2, 3, 4 respectively, the coupled inductors L12, L23, L34 can have a 500 μH value. The capacitors 41 and 42 can be chosen having a 1 μF value.

The circuit of FIG. 1 essentially requires e.g. only two power MOSFETs to create the HF voltage generator 10, one power inductor represented by the magnetic element 11 and N−1 small coupling inductors, where N is an integer representing the number of LED channels.

The capacitor 12 dispenses with the DC component of the load current, while the inductor representing the magnetic element 11 reduces the spikes due to the introduced capacitive element.

LEDs require a mono directional and preferably constant current source; in the arrangement illustrated this is ensured by the insertion of the two diodes 43, 44 and of the two ceramic capacitors 41, 42, in each channel. This structure (termed "voltage-doubler-like" in the foregoing) produces the current required, by doubling the frequency of the power source, thus making the dynamic response very fast.

The inductor 11 and the capacitor 12 jointly form a resonant circuit; if the working frequency of the MOSFETs in the generator 10 is a slightly less than the resulting resonance frequency, a low stored reactive power and MOSFET zero current operation (low switching losses) can be achieved.

Figure 2:
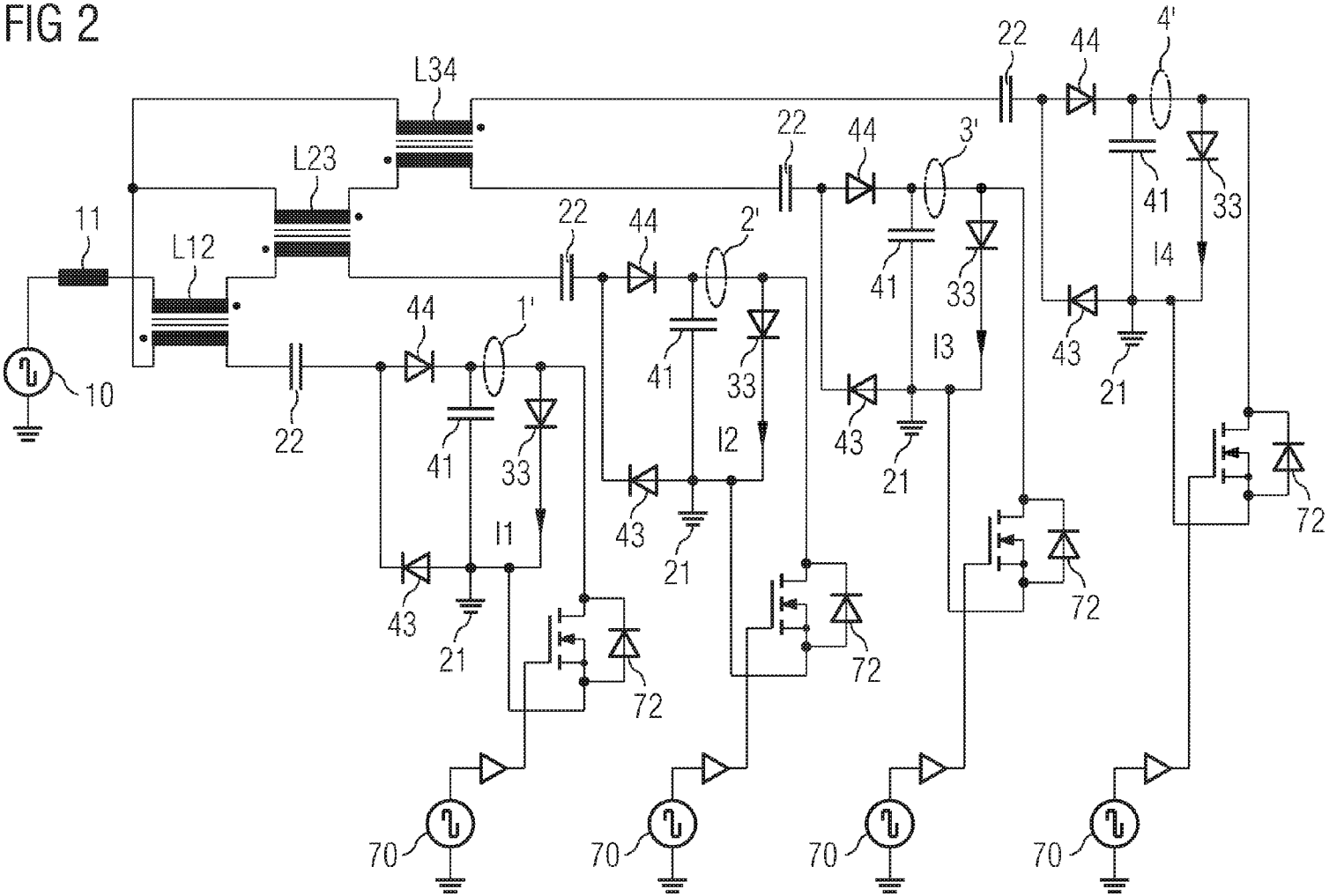
FIG. 2 is a circuit diagram exemplary of a second embodiment of the driver arrangement described herein.

FIG. 2 shows a second embodiment of a driving arrangement where, in order to permit selective variation of the brightness of the LED or LEDs driven by each channel, an extra MOSFET 72 is added on each channel 1', 2', 3', 4', driven by a respective low side driver 70, i.e. a square wave generator operating in low frequency PWM (Pulse Width Modulation) mode. Otherwise the circuit disclosed essentially corresponds to the circuit described with reference to FIG. 1, with the difference that here four decoupling capacitors 22 are placed in the respective channels 1', 2', 3', 4', downstream and in series with respect to the coupled inductors L12, L23, L34, thus removing the decoupling capacitor 12 shown in FIG. 1.

The "voltage-doubler" structure is maintained and the extra-MOSFET 72 has its drain electrode connected to the positive terminal of the LED cell 33.

Essentially, in the embodiment of FIG. 2, the single capacitor 12 of FIG. 1 is substituted with a capacitor 22 for each channel in order to avoid voltage drops caused by current flow of all channels in the same element. Also only the capacitor 41 is provided, placed in parallel with the LED cell 33. The capacitor 22, by way of example, has a capacity of 56 nF, while the capacitor 41 has a capacity of 2 μF. T other components, corresponding to those already described with reference to FIG. 1, retain the same values.

The MOSFETs illustrated are referred to ground and do not need isolated drivers. MOSFETs driver commands are in negative logic; when a LED cell 33 is off, the corresponding MOSFET 72 is conducting and shortcircuits such LED cell 33, holding the overall channel current.

Figure 3:
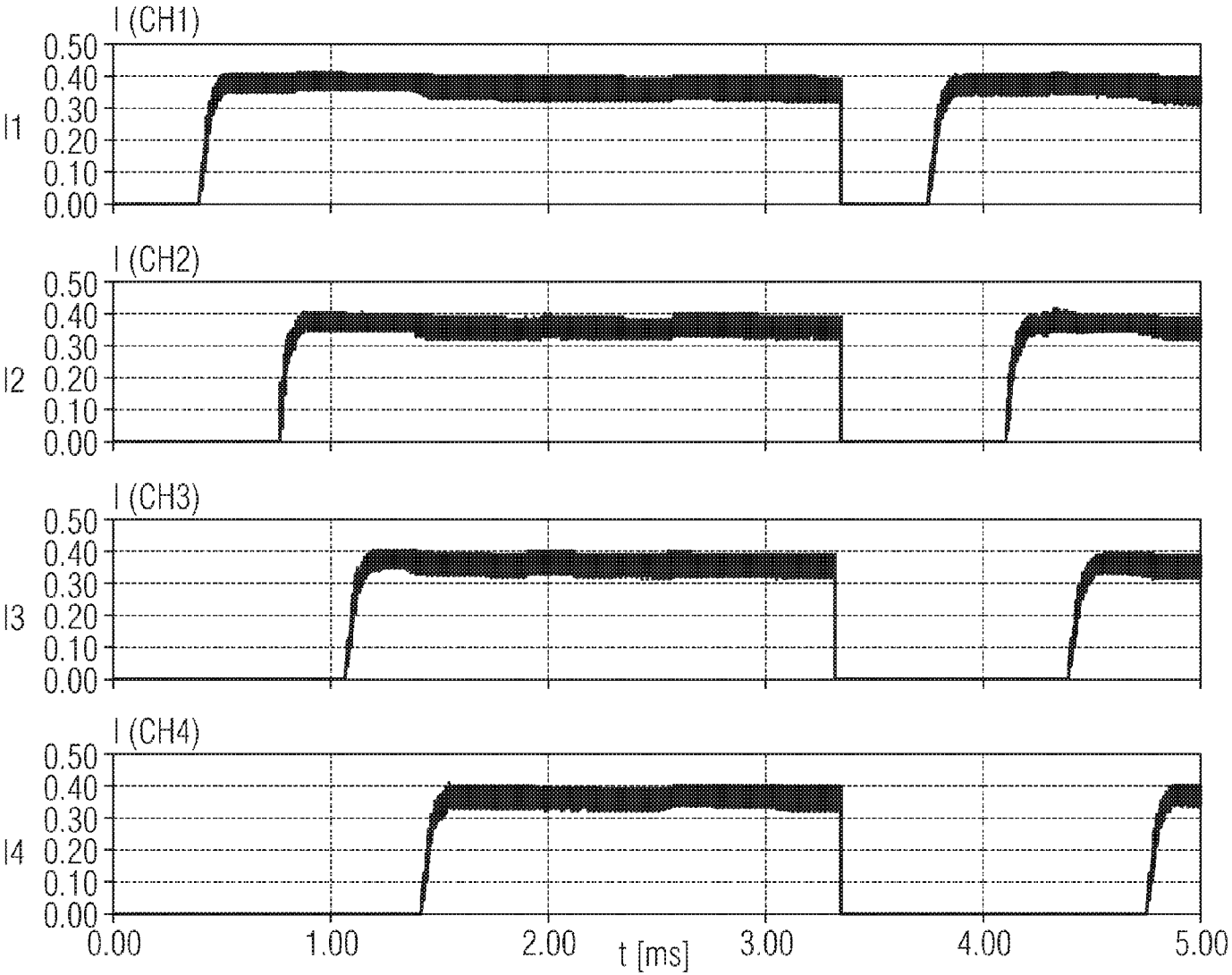
FIG. 3 is a time diagram representing currents taking place in the driver arrangement illustrated in FIG. 2.

The time diagrams shown in FIG. 3, are illustrative of currents I1, I2, I3, I4, measured for each channel as a function of time t, during a PWM dimming phase.

In experimentation carried out so far by the Inventors, LEDs with very different forward voltages have been used (more than 50%), while using PWM control signals with the same frequency, with different switch-on intervals Ton applied to the three channels. The resulting waveforms show that the starting currents are similar, while the current of a channel is quite unaffected by the disconnection of the other channels.

The arrangement proposed finds its application not only in association with resonant circuits, but also in association with converters having different topologies and operating on parallel LED channels. For instance, it can be applied in association to an inverter that feeds the current through a driving stage including one or two MOSFETs. In this case the filtering inductors can be obtained by the leakage inductances of the same mutual inductors placed on the parallel channels.

Also in this example it is convenient to reset the current in the mutual inductor at each switching cycle. According to such mode operation, the best performances can be obtained by operating the converter in a "borderline" fashion, i.e. at the border between continuous and discontinuous operation.

Those of skill in the art will appreciate i.a. that:

while four channels are exemplified here, the cells and channels in question may in fact be in any number (the illustration of the possible presence of three cells in the drawing being thus of purely exemplary nature), and each channel may include channels with either a single LED or a plurality of LEDs.

In particular, the proposed arrangement is effective not only in association with RGB systems, but in general with parallel LED channels. For instance, when it is desired to have a high power, i.e. to use 24 white LEDs, these LEDs have to be placed in parallel chains, in order to avoid the excessive voltage drop that is determined by a series configuration and that would require a voltage exceeding the voltage limits imposed by the current regulations, e.g. 25 Vrms. Therefore the relevant circuit has to be configured according at least four parallel channels having six LEDs each, that the proposed arrangement is able to drive adding just a few low cost components for each channel.

Without prejudice to the underlying principles of the invention, the details and embodiments may vary, even significantly, with respect to what has been described in the foregoing, by way of example only, without departing from the scope of the invention as defined by the annexed claims.

Therefore, while a particular embodiment of the present invention has been shown and described with specific attention paid to its possible use in driving RGB LED sources, it should be understood that the present invention is not limited thereto since other embodiments may be made by those skilled in the art without departing from the scope thereof. It is thus contemplated that the present invention encompasses any such embodiments including the driving of a multichromatic lighting system, e.g. a tunable-whit lighting system

The invention claimed is:

1. A driving arrangement for feeding current generated by a high frequency generator to a plurality of LED cells each including at least one LED, the arrangement including a respective plurality of LED channels arranged in a parallel configuration and one or more coupled inductors, said coupled inductors placed on each channel of said plurality of LED channels, coupling pairs of channels among said plurality of LED channels, and respectively including a first coil on a first channel of said pairs of channels and a respective mutual coil on a second channel of said pairs of channels, wherein said plurality of LED channels include respective voltage doubler structures for feeding said LED cells.

2. The arrangement of claim 1, further comprising a driver stage including at least a MOSFET cascaded to said high frequency generator.

3. The arrangement of claim 1, wherein said high frequency generator is configured for resetting the current flowing in said one or more coupled inductors at each switching cycle.

4. The arrangement of claim 1, further comprising a magnetic element cascaded to said high frequency generator.

5. The arrangement of claim 1, further comprising a decoupling capacitor arranged in the flowpath of said current towards said plurality of LED channels.

6. The arrangement of claim 1, wherein said plurality of LED channels include respective additional electronic switches for performing a dimming function.

7. The arrangement of claim 6, wherein said respective additional electronic switches are coupled to low side drivers driving said respective additional electronic switches according to a PWM dimming mode.

8. The arrangement of claim 1, further comprising a plurality of decoupling capacitors each arranged in a respective one of said LED channels.

9. The arrangement of claim 8, wherein said plurality of decoupling capacitors are arranged downstream of a coupled inductor in the respective one of said LED channels.

* * * * *